US006974391B2

(12) United States Patent
Ainsworth et al.

(10) Patent No.: US 6,974,391 B2
(45) Date of Patent: Dec. 13, 2005

(54) METHOD AND APPARATUS FOR UNIQUELY IDENTIFYING A GOLF BALL AT A TARGET

(76) Inventors: Clifford L. Ainsworth, 605 - 3rd Avenue, SW, Salmon Arm (CA) V1E 1T1; Robert G. Leach, 605 - 3rd Avenue, SW, Salmon Arm (CA) V1E 1T1

( * ) Notice: Subject to any disclaimer, the term of this patent is extended or adjusted under 35 U.S.C. 154(b) by 277 days.

(21) Appl. No.: 10/183,750

(22) Filed: Jun. 28, 2002

(65) Prior Publication Data

US 2003/0004005 A1 Jan. 2, 2003

Related U.S. Application Data

(60) Provisional application No. 60/336,098, filed on Dec. 6, 2001, provisional application No. 60/301,473, filed on Jun. 29, 2001.

(51) Int. Cl.[7] ..... A63B 69/36
(52) U.S. Cl. ..... 473/153; 473/156; 473/191
(58) Field of Search ..... 473/151–160, 473/173, 178, 180, 182, 190–192, 409

(56) References Cited

U.S. PATENT DOCUMENTS

| | | | | |
|---|---|---|---|---|
| 5,102,140 A | | 4/1992 | Vincent | |
| 5,184,824 A | | 2/1993 | Riedinger | |
| 5,370,389 A | * | 12/1994 | Reising | 473/153 |
| 5,439,224 A | * | 8/1995 | Bertoncino | 473/153 |
| 5,445,374 A | * | 8/1995 | Clark, Jr. | 473/191 |
| 5,513,841 A | * | 5/1996 | Takagi | 473/134 |
| 5,582,550 A | * | 12/1996 | Foley | 473/153 |
| 5,626,531 A | | 5/1997 | Little | |
| 5,653,642 A | * | 8/1997 | Bonacorsi | 473/153 |
| 5,798,519 A | * | 8/1998 | Vock et al. | 250/206.1 |
| 5,860,648 A | * | 1/1999 | Petermeier et al. | 273/108.2 |
| 6,320,173 B1 | * | 11/2001 | Vock et al. | 250/206.1 |
| 6,322,455 B1 | * | 11/2001 | Howey | 473/168 |
| 6,569,028 B1 | * | 5/2003 | Nichols et al. | 473/192 |
| 6,607,123 B1 | * | 8/2003 | Jollifee et al. | 235/375 |
| 2001/0021673 A1 | | 9/2001 | Cleveland | |
| 2002/0177490 A1 | * | 11/2002 | Yong et al. | 473/353 |

FOREIGN PATENT DOCUMENTS

| | | |
|---|---|---|
| CA | 2324541 | 9/1999 |
| JP | 8112387 | 5/1996 |
| JP | 2002-126149 | 5/2002 |
| JP | 2002-159608 | 6/2002 |
| WO | PCT/US99/16496 A2 | 7/1999 |

* cited by examiner

*Primary Examiner*—John M. Hotaling, II
(74) *Attorney, Agent, or Firm*—Antony C. Edwards

(57) ABSTRACT

An apparatus for uniquely identifying a golf ball at a target includes a simulated golfing green having one or multiple target area apertures therein. A ball collector is mounted under each aperture. A ball identification means cooperates with the ball collector for identifying uniquely identified game balls from non-uniquely identified golf balls and transmits identity information corresponding to each game ball of the game balls to a remote processing station for correlating the identity of a golfer with the identity information. A surveillance means cooperates with the first target area so as to provide for remote monitoring of the first target area. A first signal means is provided for signalling the golfer and a remote monitor when a uniquely identified game ball has entered the aperture. A first sensor means is provided for detecting when a uniquely identified game ball lands in the first target area and for signalling the golfer and a remote monitor upon such detection.

26 Claims, 10 Drawing Sheets

METHOD AND APPARATUS FOR UNIQUELY IDENTIFYING A GOLF BALL AT A TARGET

CROSS REFERENCE TO RELATED APPLICATION

This application claims priority from U.S. Provisional Patent Application No. 60/301,473 filed Jun. 29, 2001 entitled Method and Apparatus for Uniquely Identifying a Hole-in-One Golf Ball and U.S. Provisional Patent Application No. 60/336,098 filed Dec. 6, 2001 entitled Method and Apparatus for Uniquely Identifying a Golf Ball at a Target.

FIELD OF THE INVENTION

This invention relates to sports generally, and in particular, to a method and apparatus to improve the sport of golf by providing for uniquely identifying a prize-winning golf ball which is sunk in a target hole or otherwise lands on a designated target area. The methods described for identifying, for example, a unique hole-in-one golf ball may also be used to identify golf balls that successfully reach other targets areas or holes.

In the sport of golf, hitting a so-called hole-in-one is so rarely accomplished that its attainment elevates the status of the successful player. It is so difficult to achieve that often in professionally organized golf tournaments a hole-in-one earns the successful player a prize, independent of who wins the tournament overall. Such prizes may be very valuable, such as new cars and the like, in which case they are sometimes funded by insurance. That is, the tournament organizers purchase hole-in-one insurance and the insurance company only pays for the prize upon a successful hole-in-one shot. The insurance companies however place conditions on pay out for such prizes, one condition being that the tournament organizers provide spotters at each hole to witness and verify the legitimacy of an insurance claim. In this instance, and in many other instances in playing and practicing golf, the identification, verification and surveillance of prize winning golf balls would be advantageous, and it is an object of the present invention to provide same.

In the prior art, applicant is aware of various attempts to identify and locate golf balls, for example, Canadian Patent No. 2,324,541 which issued to Jolliffe, U.S. Pat. No. 5,423,549 which issued to Englmeier, U.S. Pat. No. 5,447,314 which issued to Yamazaki et al., U.S. Pat. No. 5,626,531 which issued to Little, U.S. Pat. No. 5,743,815 which issued to Helderman, U.S. Pat. No. 5,820,484 which issued to Terry, and U.S. Pat. No. 6,113, 504 which issued to Kuesters.

None of this prior art teaches, and it is an object of the present invention to provide, a golf ball identification system which allows golfers, for example in a driving range, to test their skill at sinking a golf ball in a hole-in-one or other supplied targets areas and to be uniquely identified for prize payouts upon successfully sinking a hole-in-one or hitting one of the other supplied targets.

SUMMARY OF THE INVENTION

In one embodiment of the present invention, a computer-controlled system causes a vending machine to distribute one uniquely marked/identified golf ball with, for example, each bucket of balls requested by a golfer. The marked ball is marked or otherwise identified to uniquely identify that golfer. Each golfer may purchase extra marked/identified balls from a centrally located kiosk, for example located on the tee-off floor. A confirmation system allows a central monitoring organization to confirm successful holes-in-one or success at hitting other targets, for example 6 foot diameter targets, or 2 foot diameter targets, through video or other interfaces (which may be digital) and, for example, by use of printing mechanisms to uniquely identify a particular golf ball.

Each system includes a pair of simulated green and cup/target assemblies, each having a video camera mounted on a pole associated with the cup for monitoring the opposite green and cup assembly, and an embedded video camera and/or other sensing means embedded beneath the green and cooperating with the cup for detecting and identifying any golf balls falling into the cup or other target areas. Alternatively, a single simulated green and cup/target assembly may be employed using a video camera positioned at a remote location for monitoring the green and cup assembly.

The object is for golfers to aim golf balls at the green and cup/target assemblies so as to sink one of the uniquely marked/identified balls into the cup or to hit other target areas. The cup video camera and/or other detectors allows for verifying that a ball falling into a cup or landing in a fixed area is a uniquely marked ball, and the video camera monitoring that particular green and cup assembly allows for verification that the ball was in fact likely legitimately shot by a golfer rather than being fraudulently deliberately placed into the cup by a golfer merely walking up to the green and cup assembly. A successful hole-in-one shot or other shot hitting a defined target area using a uniquely marked/identified ball results in a prize being awarded to the golfer.

According to one aspect of the present invention, in one arrangement a green and cup assembly is mounted into a green approximately 120 yards from the tee-off, and a second green and cup assembly is mounted into the green approximately 150 yards from the tee-off. This pair of green and cup assemblies may then cooperate by the pole-mounted video camera on one assembly monitoring the other assembly and vice versa. Because of the additional difficulty in successfully completing a hole-in-one shot on the 150 yard hole, as compared to the 120 yard hole, a larger prize may be awarded for the former as compared to the latter. Other larger target areas will have prizes consistent with the difficulty of hitting the target area.

Video monitoring and other administration of the system may be accomplished remotely from a central monitoring location or organization and may be accomplished as, for example, by use of secured socket layers over the Internet. This may provide for complete administration of all related financial data by the central monitoring organization. Further, such a real-time or live connection will allow the monitoring organization to conduct daily tests of the video and electromechanical devices associated with the green and cup assembly.

In summary, the apparatus for uniquely identifying a hole-in-one and other target golf balls includes in one embodiment, a pair of assemblies mountable into a golf green, or simulating such, spaced apart within a visual surveillance distance of one another. Each assembly of said pair of assemblies comprises a surveillance means, mounted to said assembly, for remote surveillance, by signal transmission to a remote location, of a second said assembly within said visual surveillance distance. Each said assembly also comprises a ball detection and identification means for detecting a golf ball in a cup in said assembly and for inspecting said ball to allow identification of the ball as, firstly, a uniquely marked/identified ball, and, secondly, as a particular uniquely marked/identified ball so as to allow correlation of the particular uniquely marked/identified ball to a corresponding successful golfer. In a related embodiment, a single remote surveillance means monitors a single target and ball detection/ID assembly.

The apparatus of the present invention for uniquely identifying a golf ball at a target includes a simulated golfing green first target area having a hole-in-one aperture therein. A ball collector is mounted under the aperture. A ball identification means cooperates with the ball collector for identifying uniquely identified game balls from non-uniquely identified golf balls and transmits identity information corresponding to each game ball of the game balls to a remote processing station for correlating the identity of a golfer with the identity information. A surveillance means cooperates with the first target area so as to provide for remote monitoring of the first target area. A first signal means is provided for signalling the golfer and a remote monitor when a uniquely identified game ball has entered the aperture. A first sensor means is provided for detecting when a uniquely identified game ball lands on the first target area and for signalling the golfer and a remote monitor upon such detection.

The simulated golfing green may further include at least a second target area which at least partially surrounds the first target area. A second sensor means is provided for detecting when a uniquely identified game ball lands on the second target area and for signalling the golfer and a remote monitor upon such detection. Identity correlation means identifying the game ball and correlating the game ball to a golfer. A ball collector strip may be mounted on the second target area.

The simulated golfing green may further include a landing zone adjacent the target areas and disposed so as to lie between the target areas and the golfer. The simulated golfing green may be inclined upwardly from the horizontal towards the golfer.

A second simulated golfing green may be provided which is substantially identical to the first simulated golfing green. The second golfing green is positioned apart from the first simulated golfing green. A second surveillance means cooperates with the second simulated golfing green. The first surveillance means has a first field of view which includes the second simulated golfing green and wherein the second surveillance means has a second field of view which includes the first simulated golfing green.

The ball identification means may include both radio frequency identification transponders mountable into the uniquely identified game balls and corresponding radio frequency identification sensors mounted into cooperation with the ball collector. The ball identification means may also comprise of or include both a unique color, icon, symbol or other marking applied to the uniquely identified game balls and a color or mark detecting sensor cooperating with the ball collector.

The ball collector may include a conduit leading to a ball manifold. The first target area may include a separate ball collector cooperating with the ball manifold via a second conduit. The first target area ball collector may be an elongate ball collecting trough mounted generally laterally across the first target area. A first ball collecting trough may be mounted laterally across the first target area, and a second ball collecting trough may be mounted laterally across the second target area. Multiple troughs may extend across multiple target zones. The first and second troughs may feed separate conduits which feed into the ball manifold. A ball separator may be mounted in cooperation with the ball manifold so as to detect uniquely identified game balls. Culling means may be provided for culling the game balls from the non-uniquely identified golf balls.

In an alternative embodiment, multiple ball collectors located under the hole-in-one aperture make up a multiple win zone configuration identifying uniquely identified game balls from non-uniquely identified golf balls and transmits identity information corresponding to each game ball of the game balls to a remote processing station for correlating the identity of a golfer with the identity information.

The method of the present invention for uniquely identifying a golf ball at a target includes the steps of:

(a) providing a simulated golfing green first target area having a hole-in-one aperture therein, (b) providing a ball collector mounted under the aperture and detecting golf balls entering the aperture, (c) providing a ball identification means cooperating with the ball collector and identifying uniquely identified game balls from non-uniquely identified golf balls and transmitting identity information corresponding to each game ball of the game balls to a remote processing station and correlating the identity of a golfer with the identity information. Game balls may be separated before or after reaching the ball identification means or not separated at all.

(d) providing a surveillance means cooperating with the first target area and remotely monitoring the first target area, (e) providing a first signal means and signalling the golfer and a remote monitor when a uniquely identified game ball has entered the aperture, (f) providing a first sensor means and detecting by the first sensor means when a uniquely identified game ball lands in the first target area and signalling the golfer and a remote monitor upon the detection.

The method may further include the step of providing at least a second target area which at least partially surrounds the first target area, and providing a second sensor means and detecting by the second sensor means when a uniquely identified game ball lands on the second target area and signalling the golfer and a remote monitor upon the detection, and correlating the identity of the game ball to a golfer.

The method may further include providing a second simulated golfing green substantially identical to the first simulated golfing green and positioning the second simulated golfing green apart from the first simulated golfing green, providing a second surveillance means cooperating with the second simulated golfing green. Aligning the surveillance means so that the first surveillance means has a first field of view which includes the second simulated golfing green and so that the second surveillance means has a second field of view which includes the first simulated golfing green. The second surveillance means monitors the first simulated golfing green and the first surveillance means simultaneously monitors the second simulated golfing green.

The method may also include identifying the game balls by radio frequency identification, and may also include sensing the game balls' colors and selecting game balls from other golf balls based on the color of the ball.

In the method of the present invention the identifying step includes sensing the movement of the ball to be analyzed as it enters into an analysis area of the ball identification means. Provided therein are multiple pairs of optical sensors. A first pair of optical sensors determine that a ball is entering the area. A second pair of optical sensors, spaced downstream, sense that the ball has continued in its downstream motion.

Color or contrast sensors may be provided for sensing the color or contrast of a golf ball to determine whether the golf ball is of a selected color or contrast. The sensor data is processed to remove interference of extraneous markings, so as to provide differentiation data of the color or contrast of a range ball or a game ball. That information is retained, for example in a processor's memory. A third pair of optical sensors are arranged to detect when a golf ball is in an eject location and, based on the differentiation data, eject game balls from a normal range ball flow path.

DETAILED DESCRIPTION OF EMBODIMENTS OF THE INVENTION

Figure 1:
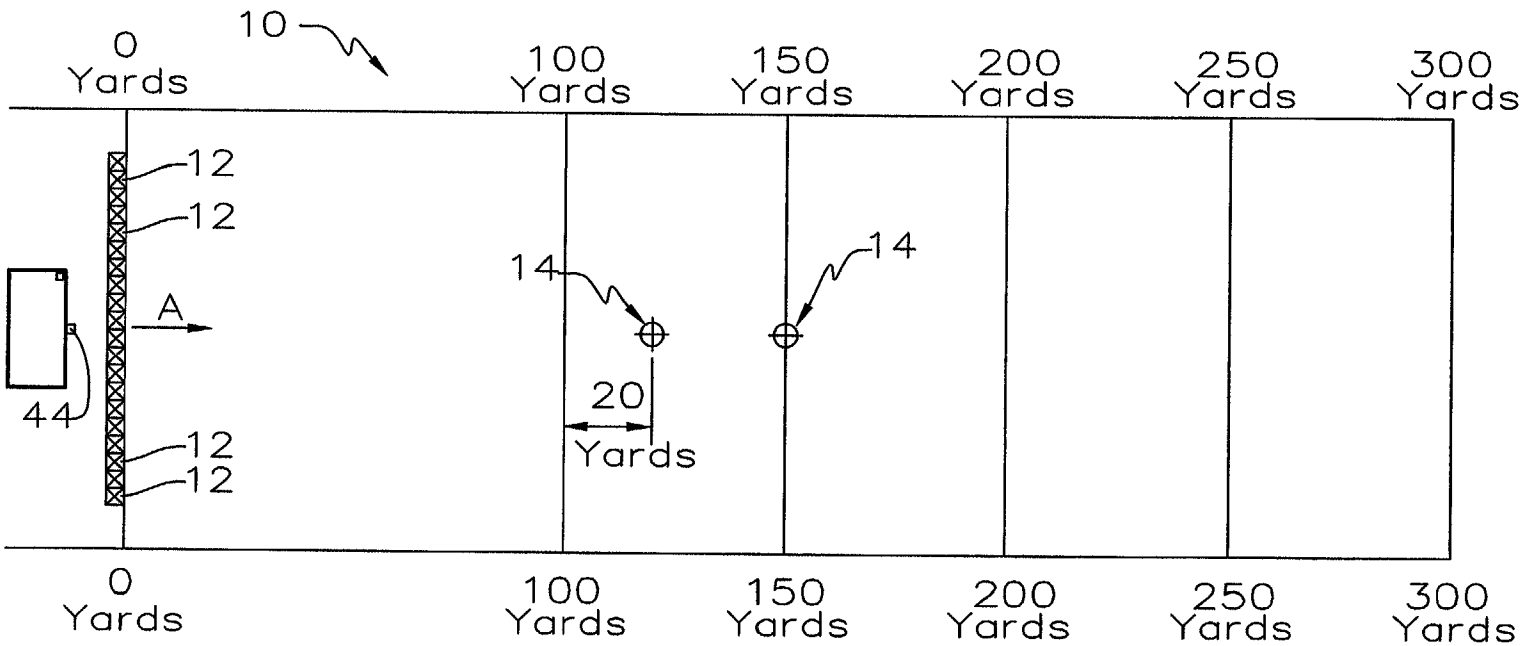
FIG. 1 is, in plan view, a driving range incorporating the method and apparatus for uniquely identifying a hole-in-one golf ball of the present invention.
Figure 2:
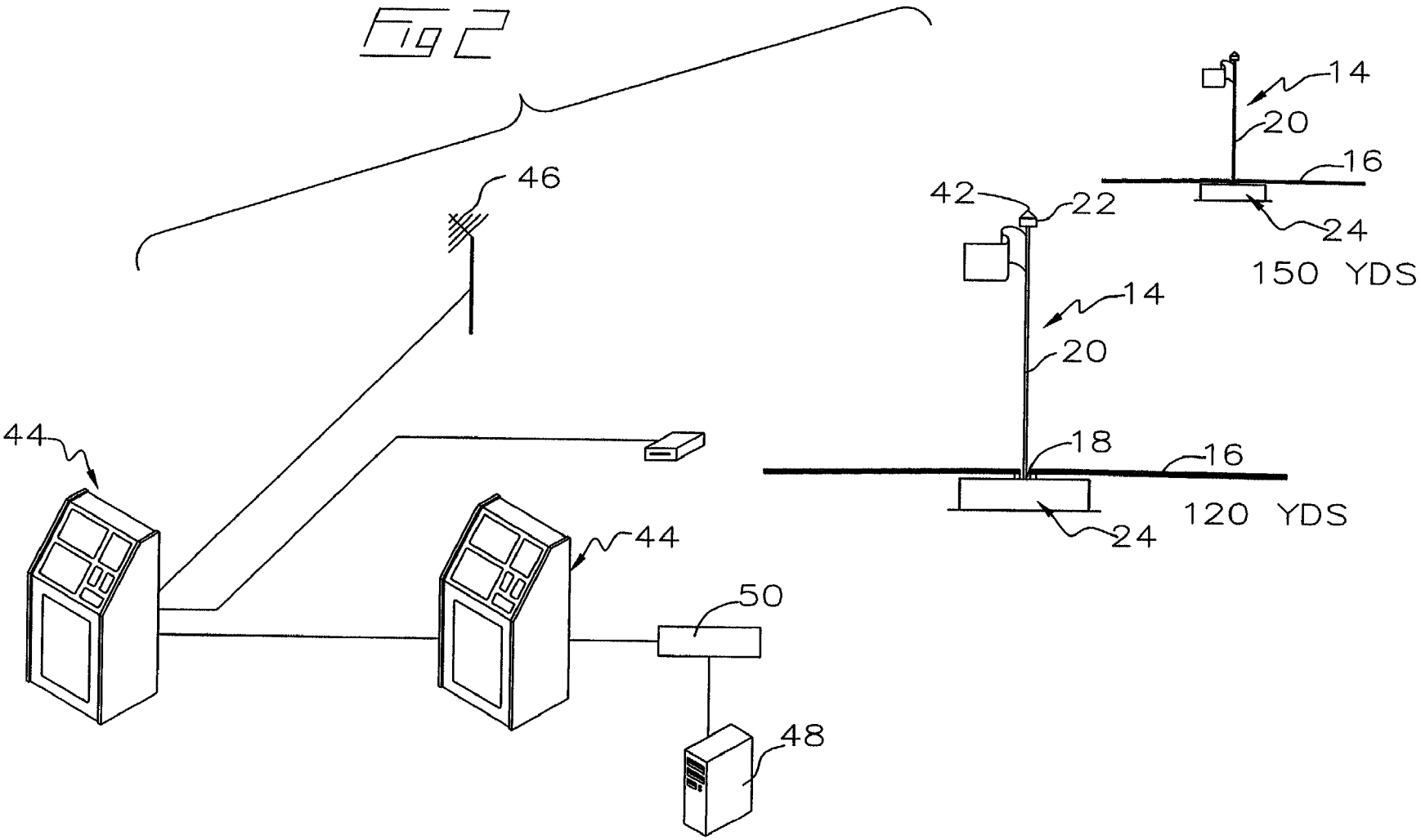
FIG. 2 is a diagrammatic view of a system incorporating the present invention.
Figure 3:
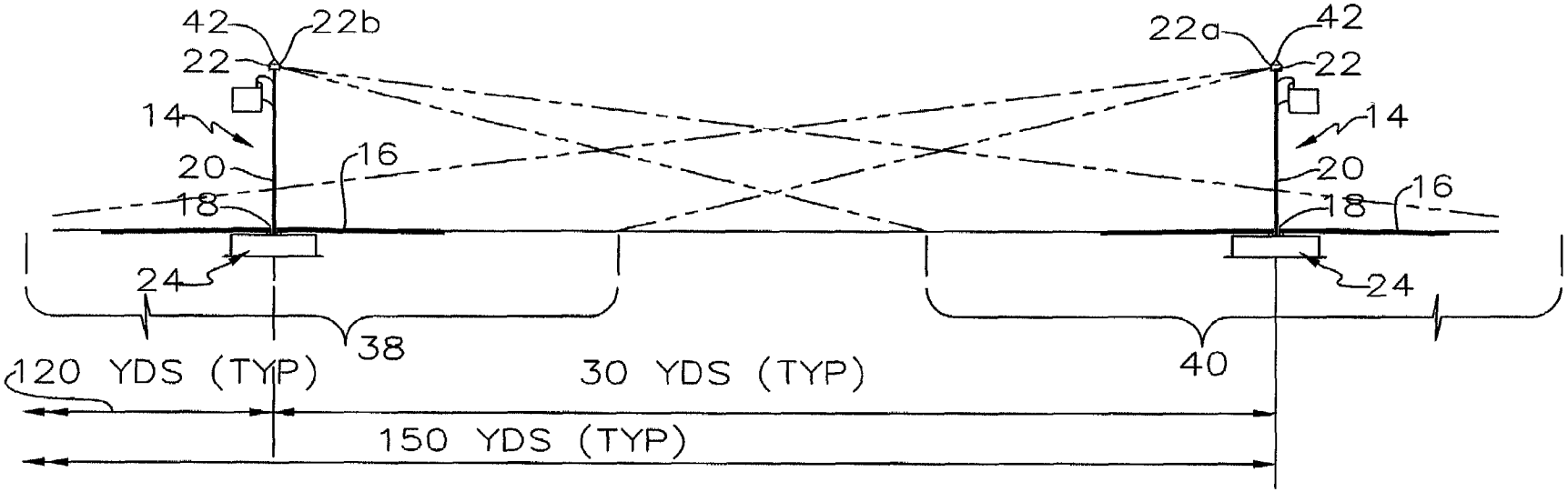
FIG. 3 is a cross-sectional side elevation view of the green of FIG. 1 incorporating a pair of green and cup assemblies according to the present invention.
Figure 4:
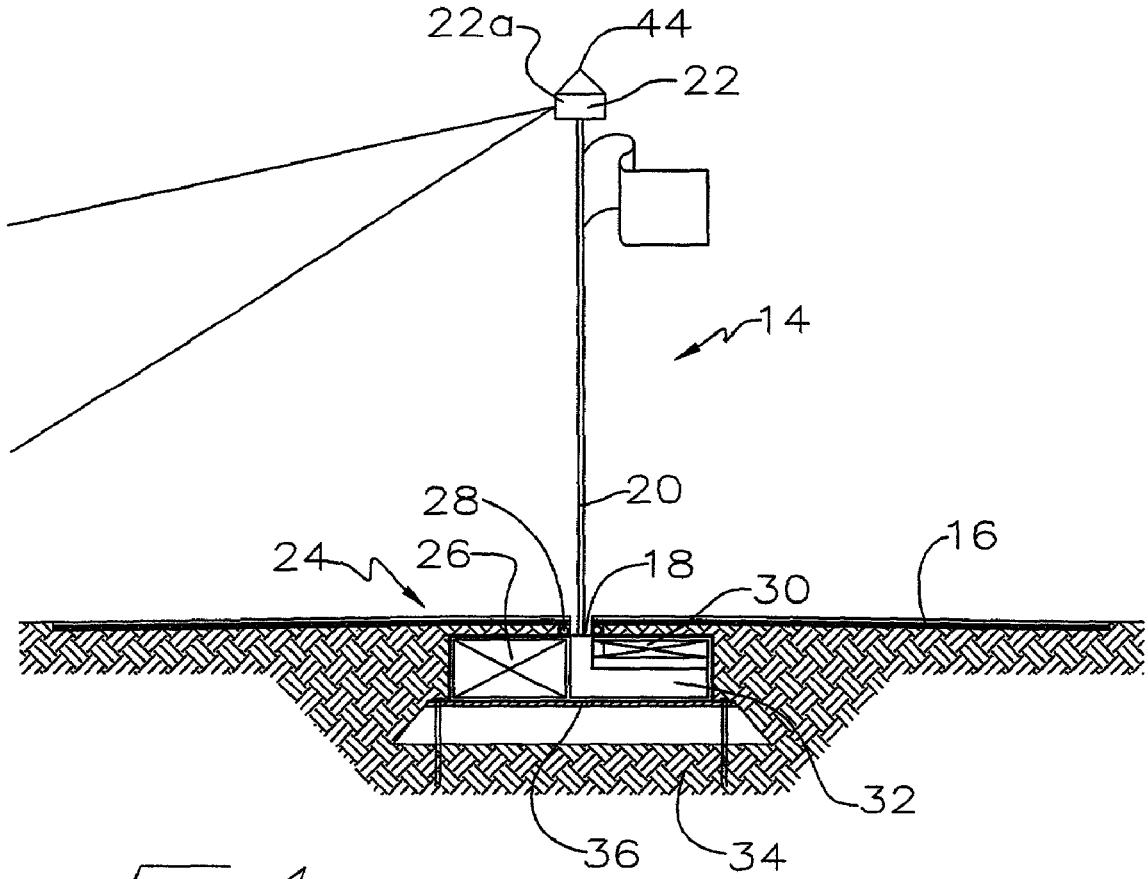
FIG. 4 is, in enlarged sectional view, one of the green and cup assemblies of FIG. 3.
Figure 4D:
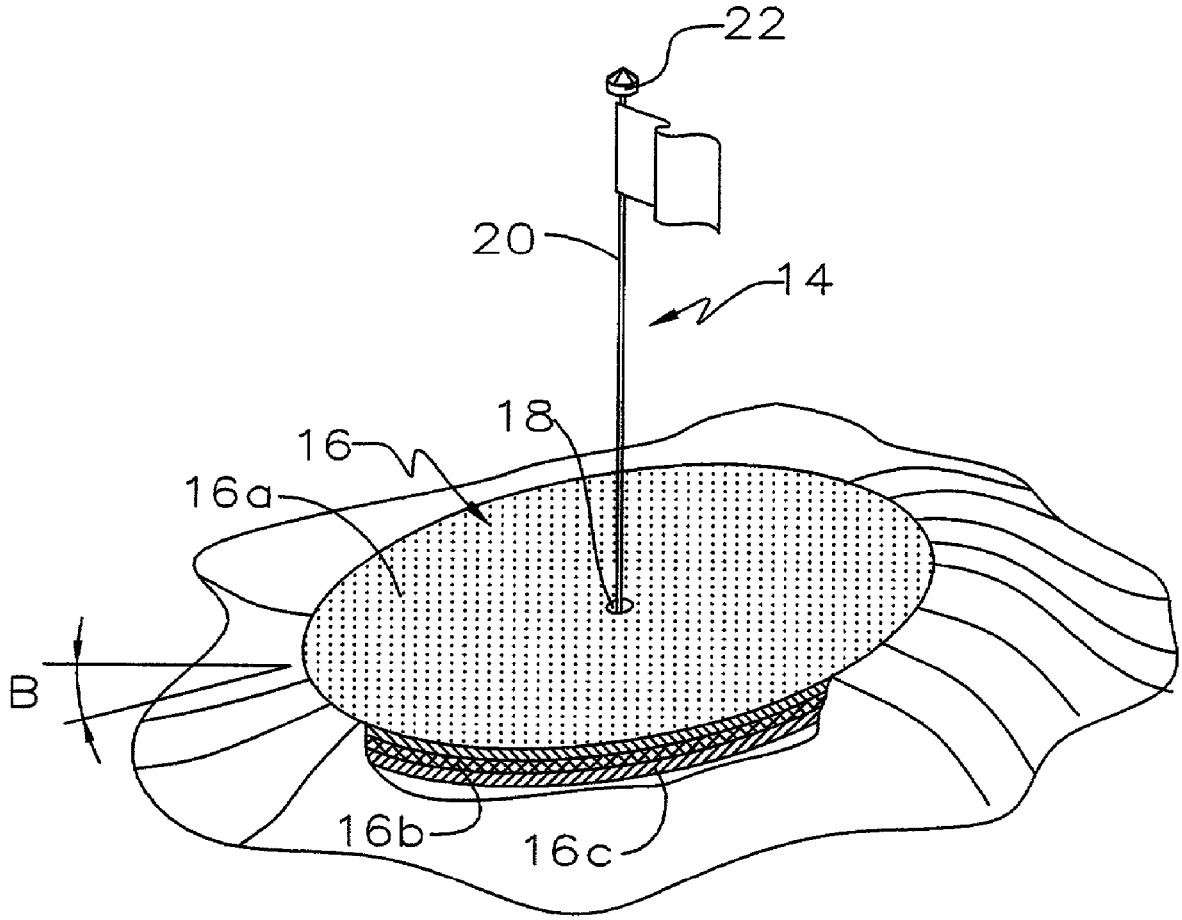
FIG. 4*a* is, in enlarged partially cut-away perspective view, a green and cup assembly such as seen in FIG. 4, mounted inclined toward the player on a curved or domed playing green.

The following describes a system which avoids the use of complex and difficult to install ball return systems, and the use of complex and expensive ball identification systems such as found in the prior art.

Each system according to the present invention may contain the following elements:

Golf Ball Identification—Golf balls are labeled and/or printed with identification marks on each ball to ensure verification at the cup via video transfer while administering the time and clarity of each purchased marked ball. A number of techniques are described below. One method includes the use of radio frequency identification (RFID) transponders encapsulated within the golf ball.

Green Clearing System—With the addition of the system at a driving range, it is anticipated that a majority of the range balls will be directed to the marked ball greens in preparation for the skills challenge for the winning prize. This creates a situation where the greens will become cluttered with balls making it an unacceptable degree of difficulty to get a hole-in-one. A number of techniques/systems are described below that will clear the green with little or no interference or interruption to the golfer.

Winning Golf Ball Verification—As described further below, golf balls as they enter the green's cup are received and identified as to whether it is a normal range ball or one of the recently dispensed uniquely identifiable marked balls. This information is transmitted to the Point of Sale (POS) Kiosk Terminal where the unique identification can be verified by the dispensing/marking equipment, the local operator and, via the Internet, the equipment provider.

System Administration—A system comprising a computer, software, wireless telemetry techniques, hardware interfaces and the Internet, allow the system operators to monitor all aspects of the system's functionalities, usage, prize allocation and accounting from a remote location.

Green and Cup Assembly—A green and cup assembly allows rapid installation into a green. It is contained in one rugged package including:

(a) an artificial turf green area providing a clean environment for the cup which may be centrally mounted in the green area, (b) a flag pole and flag, (c) an integrated surveillance camera and wireless transmitter/antenna for monitoring one green and cup assembly, which may be a second assembly in a pair of such assemblies, (d) a control electronics assembly, (e) a solar collector (optional on the green and cup assembly), for charging an internal battery so that system may be independent of a 'mains' power supply, (f) an assembly which provides battery compartments, ball identification video camera and/or RFID transponder detectors, ball reading, ball clearing/ejector assembly, and (g) a water drain area.

In the embodiment a pair of green and cup assemblies, two identical green and cup assemblies are located on the green approximately 75 feet from each other. Each assembly provides for example both the monitoring of its own cup and surveillance of the cup on the other assembly.

The green area assembly is modular so as to improve the ease of installation, repair and replacement of the assembly. The video surveillance cameras, for example, which are mounted on poles on each green and cup assembly, are integrated in the green area assembly so as to obviate the need to mount further video surveillance cameras at other locations on the green, and thus simplifying the transmitter and power requirements of the assemblies. In one preferred embodiment, the video and data transmission from the green and cup assemblies is wireless thereby reducing the requirement of complex wiring. Thus also, each green and cup assembly is self-sufficient, preferably having its own optional solar and/or battery power, a wireless video transmitter, an embedded ball identification camera or other ball identification sensor means, and a ball clearing system.

Golf Ball Identification/Marking—Techniques—Washable paints: balls are imprinted with unique codes that remain on the ball for the duration of play and are removed by the normal washing and scrubbing of the ball prior to reuse.

Chemically altered paint, whereby an imprinted ink is erased by being passed through a chemically treated wash, i.e. acidic, caustic or neutral ph composition (compounds that change color depending on the ph—phenol red, etc).

Substrate plus paint: a dry compound (water soluble) is applied to the ball. The ball is imprinted on the substrate material. The substrate is washed off in a conventional ball wash/scrubber.

Light alterable paint: inks that disappear in the presence of high-intensity and/or coherent light (i.e. ultraviolet, laser light).

Labels: self adhesive labels printed with unique identification codes/marks are applied to the golf ball. Normal washing/scrubbing removes the water-soluble label.

RFID: radio frequency identification transponders are encapsulated within each golf ball.

Green Clearing System—Techniques—Articulated green area assembly: a target green area approximately 16 feet in diameter that moves in such a manner to apply a convexity or slope(s) and/or vibrates thereby causing the balls to move to the outer diameter of the green area.

An integrated wiper arm rotating about the green area center, thereby moving balls by rotation and centrifugal force to the peripheral of the green area.

A robotic device automatically wanders the green area and bumps into balls, thereby moving the balls to the periphery of the green area.

An above ground target platform, sloped so that golf balls automatically clear the target area. Such an above ground target platform may also be provided with an actuator to provide increased slope to the platform at timed intervals, to assist in the clearing of golf balls from the platform.

Winning Golf Ball Verification—Techniques—Range and marked/identified balls captured in the greens area cup/targets are processed by components located in compartments below the target platform. Sensors detect the presence of the captured ball, photograph/read and transmit the identification data record (for example the photo) to the computer system. Photographed marked balls may be identified by the computer as being unique by the optical recognition of the identification code. Where a code can not be reliably identified, the operator of the driving range and/or the system administrator may review the photographic image(s). Images may be viewed locally and via the Internet. In the alternate method, RFID receivers detect the presence and read the unique electronic serial number of the golf ball and transmit the unique serial number identification to the computer system.

POS Vending Kiosk Assembly—An all-in-one vending machine packaging may include:

(a) Logos and Advertising
(b) Computer system
(c) Video digitizer
(d) Coin/token/bill acceptors/credit card/ smart card mechanism
(e) Credit card reader
(f) Ticket printer
(g) Label printer/installer or, alternatively, RFID detector/reader
(h) Surveillance camera
(i) Uninterruptible Power Supply
(j) LCD touch screen for player and operator interface which provides:
  (i) Display for promotional information and advertising
  (ii) Instruction to player
  (iii) Selection of choices for number of plays and values
  (iv) Displays prize values
  (v) Displays greens camera video
  (vi) Provides verification of winning plays
  (vii) Has pop up touch screen keyboard for setup, maintenance, and reporting functions The system is self-reporting, provides daily usage and accounting information to equipment developer/distributor through its Internet (or local network) connection.

The complete system is self diagnosing, providing the operating status of the system, reporting over the Internet (network) on a scheduled regular basis. Should the system not report as scheduled, corrective action may be initiated.

Thus as illustrated by way of example in FIG. 1, the driving range 10 illustrated diagrammatically in plan view would have golfers (not shown) teeing off from tee-boxes 12 so as to shoot golf balls in direction A towards green and cup assemblies 14 as better seen in FIGS. 2—4 and 4*a*.

Each green and cup assembly 14 has a large target or green area 16, simulating a golf green, toward which golfers drive their golf balls. Green area 16 surrounds a generally centrally disposed cup 18. A flag pole 20 (or other suitable pole) is mounted in or adjacent to cup 18 so as to provide a rigid vertical support for a surveillance video camera 22 mounted atop flag pole 20. A rigid housing 24 is mounted beneath green target area 16 so as to define a cavity under and around cup 18 of sufficient size to allow mounting therein of an electronics and battery assembly 26, a ball presence sensor 28, a ball identification video camera or RFID detector/reader 30 and a ball collector 32. Moisture entering into housing 24, for example through cup 18, is allowed to drain into drain field 34 beneath housing 24 through drain 36. Green area 16 may be of layered construction comprising a first layer 16*a* of material simulating a golf green surface, such as, for example Astro Turf™, an underlying layer 16*b* of an energy absorbing material such as a sheet of porous resilient compound, with a further underlying area 16*c* of a more rigid material. The layers may be securely bonded together or otherwise fasteners to inhibit slippage. Green area 16 may be inclined generally toward tee boxes 12 at an angle "B" of for example nine degrees downwardly from the horizontal. This presentation towards the tee boxes provides greater visibility for the golfer and also provides for self clearing of for balls landing on green area 16.

A spaced-apart pair of green and cup assemblies 14, for example, spaced apart approximately 30 yards as would be the case where a first green and cup assembly is mounted into the green 120 yards from tee-boxes 12 and a second green and cup assembly is mounted into the green 150 yards from tee-boxes 12, provide for cross-surveillance by video cameras 22 of the opposite green areas 16. The cross-surveillance is illustrated diagrammatically in FIG. 3 as surveillance areas 38 corresponding to the field of view of video camera 22*a* and surveillance area 40 corresponding to the field of view of video camera 22*b*.

Each video camera 22, whether it be video camera 22*a* or video camera 22*b*, has associated with it and typically mounted cooperating with its associated video camera, wireless transmitter 42 for communicating the video signal to a remote monitoring station. As an example, transmitters 42 may communicate with terminals 44 by wireless communication via antennae 46. The data or signal may be communicated from terminals 44 to a remote monitor, terminal server 48 or the like as, for example, by transmission over the internet interface illustrated as 50, or otherwise.

Figure 5:
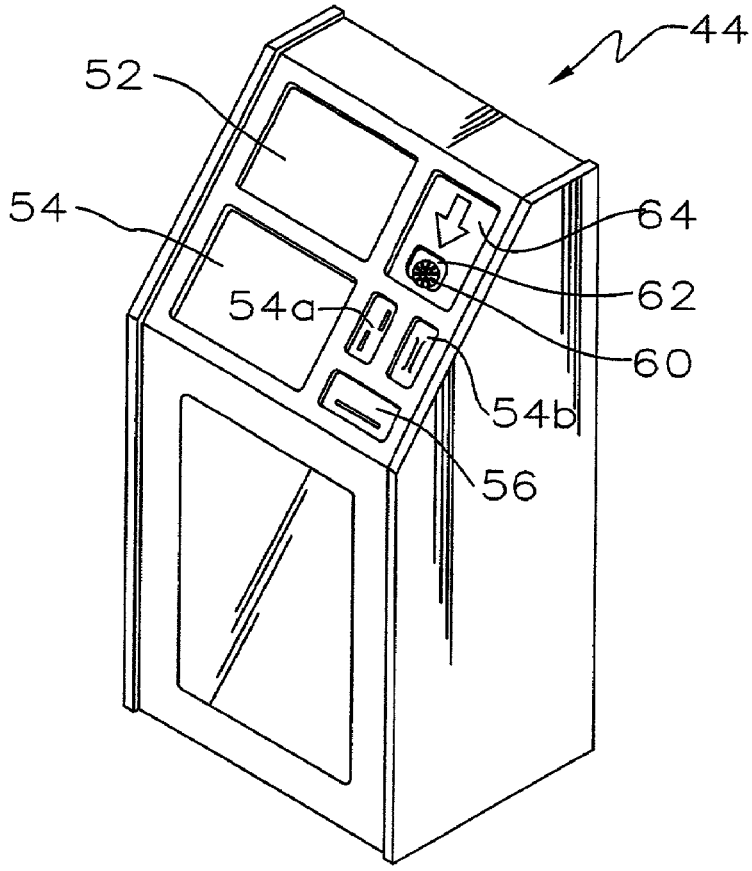
FIG. 5 is an enlarged isometric view of one of the terminals of FIG. 2.
Figure 6:
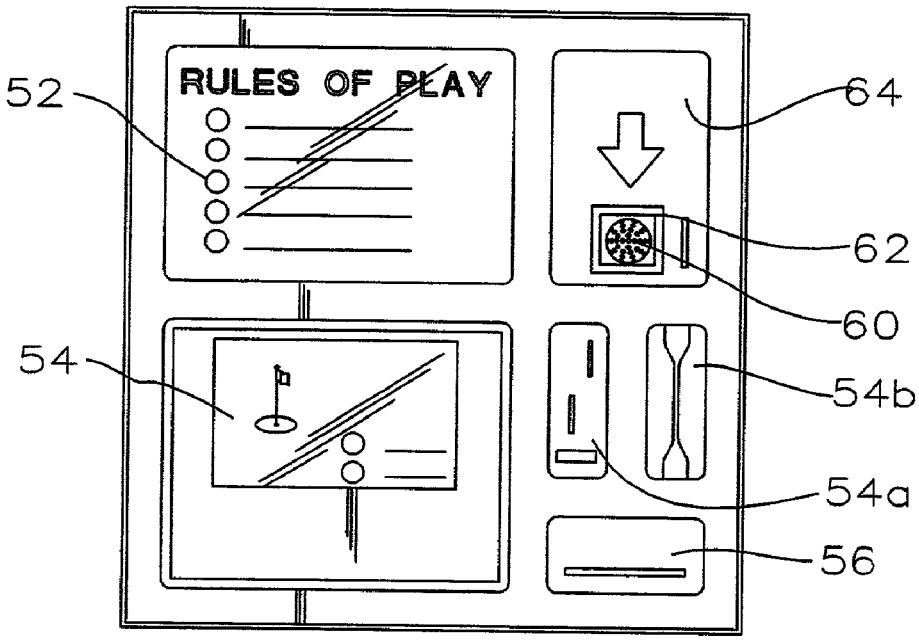
FIG. 6 is, in front elevation view, a display of the terminal of FIG. 5.

As also seen in FIGS. 5 and 6, terminals 44 may be in the form of video or vending machines which may provide an instructive area 52 containing rules for playing of the prize-winning hole-in-one game or for promotional advertising or combinations of the like. A secondary instructional area 54 may also be provided which may be a display screen which may be a liquid crystal display or otherwise for example a touch screen which would allow a golfer to interface with terminal 44 for example to indicate the method of payment or the like. Currency and credit card windows 54*a* and 54*b* respectively, enable the player to conveniently conclude the payment transaction. Confirmation of payment acceptance is dispensed from dispenser 56.

Terminal 44 will then provide a ball identification service. Upon payment by the golfer, or otherwise as part of a promotion or playing of the game as may be arranged by the operator of the driving range, a golf ball will be provided or dispensed with a unique identification. Thus a golfer may insert one of his own golf balls 60 into cavity 62 so that, for example, a ball imprinting device 64 incorporating one or more of various identification or marking techniques may uniquely identify ball 60. Alternately, the terminal will dispense a golf ball with an imbedded unique RFID transponder.

Thus a successful golfer will drive ball 60 from tee-box 12 so that in a hole-in-one shot golf ball 60 lands in or otherwise rolls into cup 18. Ball sensor 28 senses the presence of a golf ball in cup 18 and sends a notification signal via transmitter 42 so that an operator may view the video signal from ball identification video camera 30. A memory or storage device may record the video signal for playback. Review of the video signal allows for checking to see whether, firstly, the golf ball in cup 18 is a marked ball 60, and, if it is a marked ball, for recording of the unique identification of that ball so as to correlate the ball to the successful golfer as part of the verification process prior to awarding prize money. Alternatively, camera 30 may cooperate with ball collector 32 for inspection of golf balls falling from cup 18 into the ball collector. Alternatively the ball collector would include a sensor for the detection and identification of a golf ball with a unique RFID transponder. The identification information would be transmitted by transmitter 42.

Figure 8:
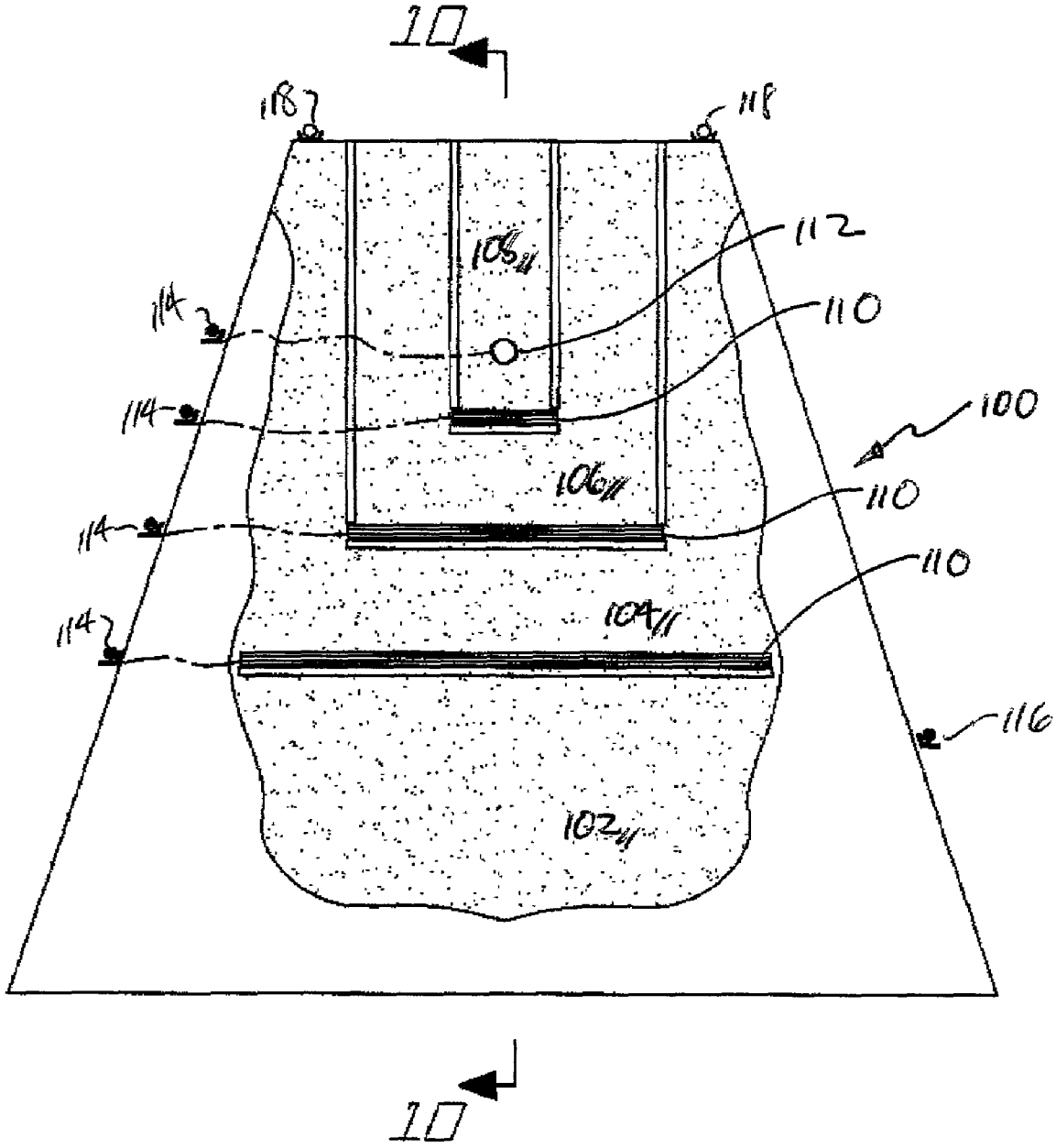
FIG. 8 is, in front perspective view, a simulated golfing green according to an alternative embodiment of the present invention.
Figure 9:
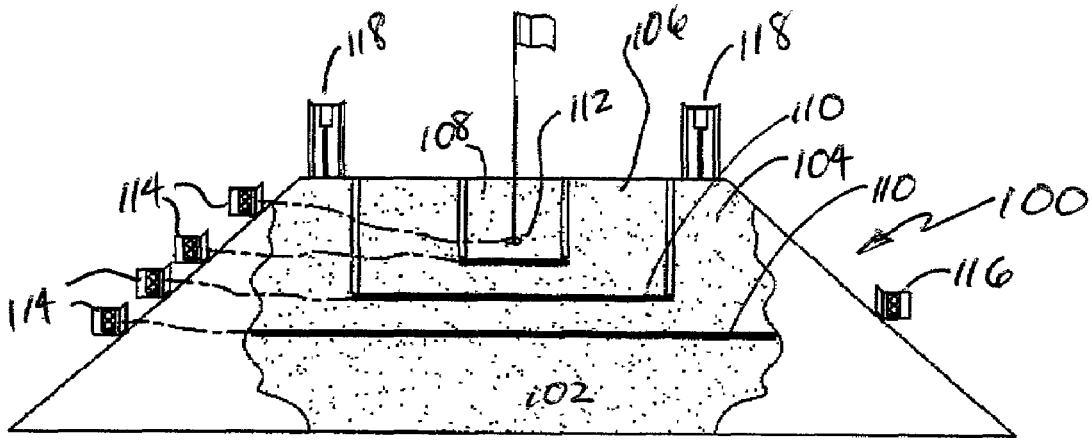
FIG. 9 is, in front elevation view, the simulated golfing green of FIG. 8.
Figure 10:
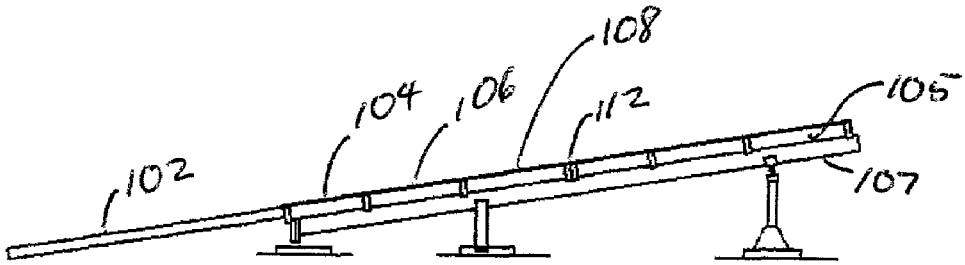
FIG. 10 is a cross sectional view along line 10—10 in FIG. 8.

Target Assemblies—In the alternative embodiment of FIGS. 8–10, the present invention includes an above-ground assembly 100 providing a realistic landing area 102 and multiple targets 104, 106 and 108.

The targets may be trapezoidal in shape so as to provide a large landing and play area, for example typically twenty-eight feet wide in the front, twelve feet wide at the rear and approximately twenty-four feet in depth. The first eight feet of the target provides a landing area 102 for golf balls as they continue their approach to the target zones of targets 104, 106 and 108.

The target surfaces may be multiple layered, providing firstly, a synthetic golf green surface, secondly, multiple layers of for example resilient materials sandwiched into a sub layer 105, and, thirdly, a solid platform or base 107. The solid platform is presented to the golfer at a typical inclined angle of nine degrees from the horizontal so that the target is visually better presented to the golfer while providing the 'self clearing' feature. A sandwich of resilient materials provides a landing surface that emulates that of a golf green, whereby the energy a golf ball striking the target surface is absorbed, inhibiting the ball from erratic bouncing or otherwise in an abnormal way.

Ball collector strips 110 of varying sizes (for example 16, 9 and 3 feet wide by approximately 4 inches) and a hole-in-one (H-I-O) cup 112 provide multiple 'win' zones for the golfer. The strips are releasably mounted so that their ball collector arrangement may be easily changed to provide different target formats.

Ball collector strips 110 may be constructed of metal rods and/or metal profiles separated by approximately 1.25" to act as ball collector troughs whereby the golf balls span the two rods or metal profiles. The tracks are inclined at approximately 4 degrees so that balls, once they are collected, roll towards the ball sensing and identifying sub systems. The open trough created by the rods or metal profiled tracks allow debris (i.e. leaves, rocks etc.) to fall through. The hole-in-one cup assembly is especially designed to trap golf balls and divert them to the ball sensor and identification sub systems. A combination of rods or metal profile guides as described above, act as the ball guides, while allowing any debris to fall out of the system.

The ball collectors (including the H-I-O cup) are provided with ball sensors (not shown). When a golf ball is sensed, multicolored strobe lights 114 are flashed, indicating to the golfer that a ball has successfully entered the ball collector and whether the ball is a 'game ball' (that is, a uniquely identified ball) or a normal range ball. Any ball entering the collector operates a first strobe light (for example amber). Upon internal processing of the received ball and determination that it is a 'game ball', another strobe light (for example red) is operated to indicate a 'win'. The multicolored strobe light is located on the target area in such a way so that it is physically close to the associated target collector/cup. The immediate visual feedback to the golfer provides information regarding the golfer's performance.

An impact sensor and associated multicolored strobe assembly 116 senses the impact of any golf ball landing on the target assembly, whether it enters the 'win' target zones or not. This multicolored (for example blue/white) strobe light provides visual feedback to the golfer that the golfer has achieved landing a golf ball anywhere on the target assembly.

Video surveillance cameras 118 are located at the rear of the target assembly looking towards the 'tee off' area. A video camera (not shown) located at the 'tee off' area is aimed towards the target area. The two cameras provide a full view to the front and rear of the target assembles.

Figure 7:
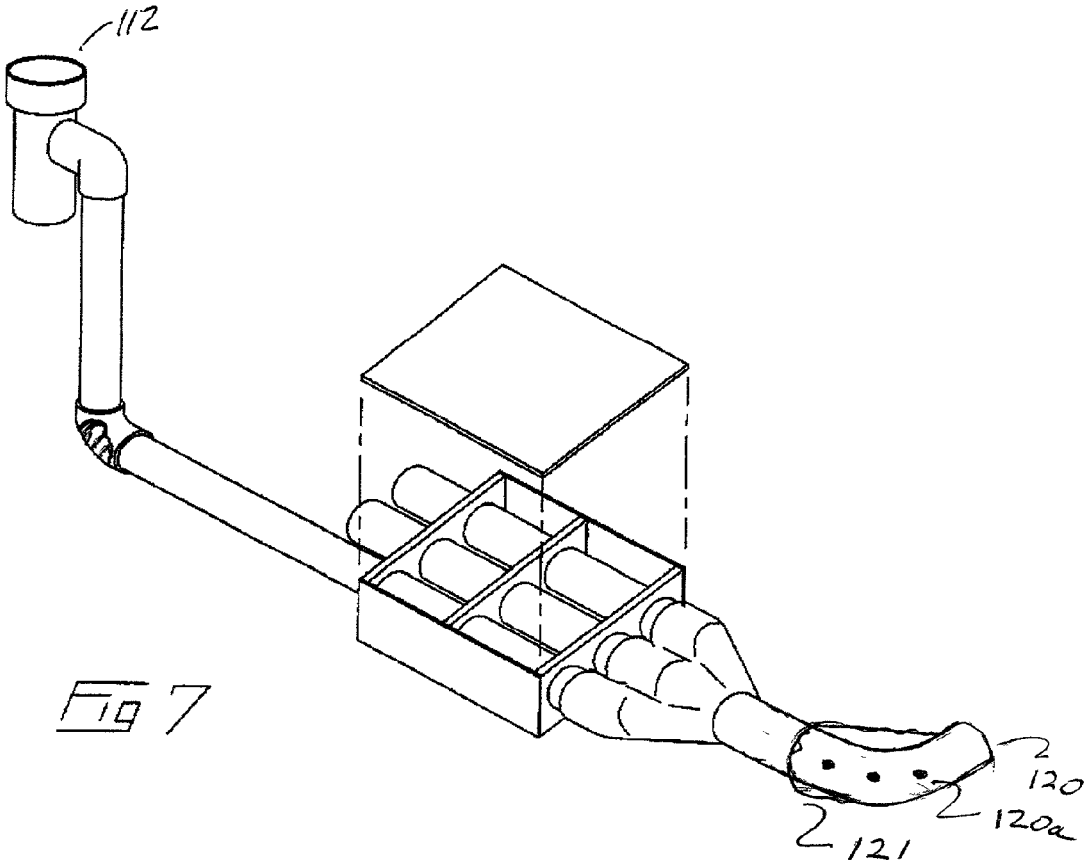
FIG. 7 is, in partially exploded partially cut away perspective view, the hole-in-one cup and its related conduit leading to a ball manifold.

RFID Reading Techniques—These techniques apply to both the Kiosk Ball Dispenser and the Target Receivers. 'Game' golf balls (as opposed to range balls) are uniquely identified with embedded conventional RFID tags (transmitters). The golf ball RFID tag is interrogated (read and registered) as the ball is dispensed and also when it is received by one of the target 'win zone' collectors. Each RFID tag has a sensitive axis whereby, when oriented perpendicular to the reading antenna coil winding can be readily read by the receiver coil and electronics. There also exists an axis of orientation of the tag where it is least sensitive, when the tags transmitting antenna coil is in axial alignment with the receiving antenna coil and this results in poor reading reliability. The tag is located within a spherically shaped golf ball, therefore there is no control over the orientation of the ball as it rolls though a read antenna coil. This will result in some balls rolling through the coil such that the tag-transmitting axis rotates concentrically (or near to being concentric) with the rolling axis of the ball and therefore will be in its worst possible read orientation as it passes through the receiving antenna coil. In applicant's experience, approximately one percent of the game balls read will result in a 'non read' due to this orientation limitation. To reduce this problem the golf ball is motivated to roll through reading antenna coil 121 on a curved path such that it changes its normal path direction by ninety degrees (such as seen in FIG. 7) over the width of the reading antenna coil. At the same time, the reading antenna coil is formed into an ellipse and 'biased' or 'skewed' such that the coil-winding axis follows the curved path of the ninety degree elbow 120 thereby providing the maximum coil reading energy along the rolling path. A further refinement includes the mounting of friction bumpers 120*a* (as seen in FIG. 7) within the curved path to further motivate the ball in its rotation as it passes through the curved path. The net result of applying all of these forces together is to cause the ball to perform a two-axis spin as it passes through the reading antenna coil. Axis number one is the roll axis of the ball and axis number two is ninety degrees to the first axis and is produced by the ninety degrees elbow and the friction bumpers. The ball therefore will never roll through the reading antenna coil without exposing its most sensitive axis to the interrogating read antenna at some point along the curved path.

Kiosk Assembly—Customer Identification Cards are credit card sized RFID tags and are used to identify specific users of the system. The status of the individually provided RFID cards allows the golfer to purchase game credits, which are recorded against his/her account. The Kiosk RFID ball dispenser/reader system is designed such that it also able to read the golfer's user card ID and provide the golfer with dispensed balls as requested. The history of the user's purchases and win activity is maintained within the computer database. This allows the system to record not only purchase/credit and win activity, but also rewards the golfer for loyalty. For example, performance over a period of time could be rewarded with prizes, which increase in value based on usage and performance.

Figure 11:
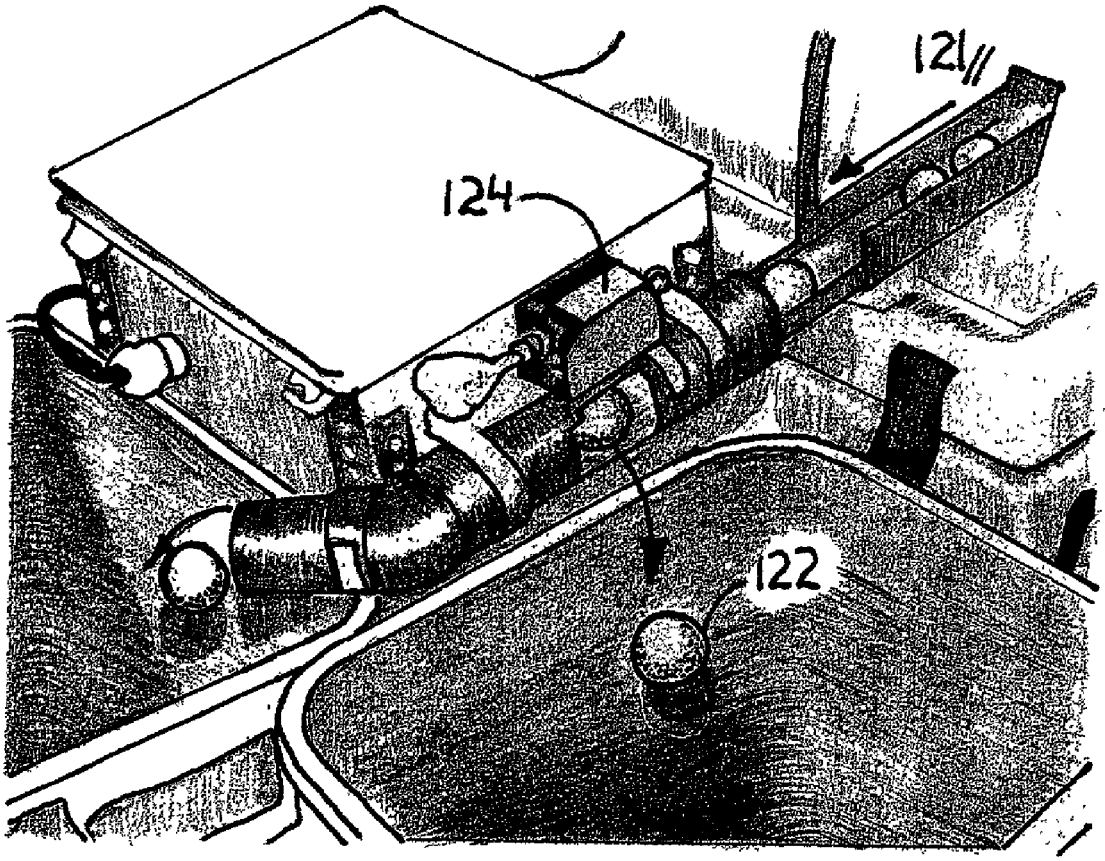
FIG. 11 is, in perspective view, the game ball sorting means used to recover RFID embedded game balls.

Ball Sorting System—Ball identification means, previously described, which include marking or otherwise identifying normal range balls, do not require any special sorting systems. The RFID identification technique however, has the further requirement of sorting the uniquely RFID identified game balls from the normal range balls so that they may be directed to the Kiosk ball dispensing system. Two systems have been developed based on sensing the embedded RFID tag and a second method based on sensing and sorting by color/contrast of the ball. To provide the least possible interruption to the normal flow of the golf ball collection, ball washing and ball dispensing in the driving range environment, as seen in FIG. 11 a ball sorter system is installed immediately at the exit of the driving range supplied golf ball washer 121. Balls that are determined to be game balls by the ball sorter are rejected and stored or transported directly to the Kiosk dispensing system while normal range balls carry on their normal path to the existing driving range golf ball storage or dispensing systems. Sorting by sensing the RFID tag uses conventional RFID reader antenna coils to sense balls as they pass through a sorting tube at a typical ball washer output of ten balls per second. Technical problems include the need to read the balls fast enough and to locate the exact position of the balls so that they can be reliably culled. Testing to date has shown that 'read rates' at five balls per second is reliable.

Sorting by sensing color of a ball has proven to work at higher rates; rates as high as 15 balls per second have proven to be very reliable by using the following techniques. Firstly, game balls are of a different color than the normal range ball and may be sorted based on their color or contrast irrespective of whether they contain embedded RFID tags or use other identification means. Secondly, sensors are used to sense the movement of the balls out of the ball washer into the ball sorter analysis area. Thirdly, sensors are used to determine whether a ball is of one color/contrast or the other, such means being intelligent enough to ignore random markings of different colors, which may be the case for company logos, whether applied to either the range or game ball. Fourthly, processing means are provided to determine that a ball is precisely in the position needed so that it may be ejected from the normal flow if it is determined to be a game ball.

Sensing techniques include:

(a) Sensing the movement of the ball to be analyzed as it enters into the analysis area by using multiple pairs of optical sensors. The first pair of optic sensors determine that a ball is entering the area, a second set, spaced approximately 0.25 inches further downstream, senses that the ball has continued in its forward and downstream motion. The fact that the ball has passed two sensor pairs confirms that the ball has moved into the analysis area and that it did not merely bounce in and out of the first sensor as may be the case due to the jittery motion of the ball as it rolls through the system. This use of two optical sensing pairs on the input side applies the needed hysteresis and is remembered by electronic logic thereby reliably establishing that the ball is in position and ready to be analyzed as to its color/contrast.

(b) Color and or contrast sensors are used to determine whether that ball is of one color/contrast or the other. Processor logic is used to remove the interference of random markings, as is the case with ball imprinting, logos or dirt, in such a way that a reliable differentiation of the color/contrast of a range ball or a game ball is determined and retained in electronic logic circuitry for subsequent use.

(c) A third pair of optical sensors detects that the ball is in the eject location and is acted upon based on the results of the color/contrast sensor and its analysis.

A game ball having passed thorough all of the sensors and being determined to be a valid game ball 122 color/contrast is ejected from the normal range ball path by use of a mechanical impulse device such as a solenoid 124. Game balls are either stored until required or may be routed automatically to the Kiosk dispensing hopper.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An device for uniquely identifying a golf ball at a target comprising:

a simulated golfing green first target area having a hole-in-one aperture therein, a ball collector mounted under said aperture, a ball identification means cooperating with said ball collector for identifying uniquely identified game balls from non-uniquely identified golf balls and for transmitting identity information corresponding to each game ball of said game balls to a remote processing station for correlating the identity of a golfer with said identity information, a surveillance means cooperating with said first target area and surveying above said first target area so as to provide for remote monitoring of said first target area, a first signal means for signalling the golfer and a remote monitor when a uniquely identified game ball has entered said aperture, a first sensor means for detecting when a uniquely identified game ball lands in said first target area and for signalling the golfer and a remote monitor upon detection, wherein said ball identification means includes radio frequency identification transponders mountable into the uniquely identified game balls and corresponding radio frequency identification sensors mounted into cooperation with said ball collector, and wherein, said radio frequency identification sensors include a receiver antenna coil and wherein said radio frequency identification transponders are RFID tags having a sensitive axis whereby, when oriented perpendicular to a winding of said receiver antenna coil is readable by said receiver coil, and wherein said each tag has a non-sensitive axis of orientation where it is least sensitive corresponding to when a transmitting antenna coil of said each tag is in axial alignment with said receiver antenna coil, and wherein said ball identification means includes a curved conduit adapted so that a golf ball rolls through said receiver antenna coil along a curved path such that the ball changes its path direction by ninety degrees while rolling through said receiver antenna coil, said receiver antenna coil mounted adjacent said conduit corresponding to said curved path, and wherein said receiver antenna coil is formed into an ellipse and biased such that a coil-winding axis of said receiver antenna coil follows said curved path.

2. The device of claim 1 wherein said simulated golfing green further comprises at least a second target area which at least partially surrounds said first target area, and a second sensor means for detecting when a uniquely identified game ball lands on said second target area and for signalling the golfer and a remote monitor upon detection, identity correlation means identifying the game ball and correlating the game ball to a golfer.

3. The device of claim 2 wherein at least one ball collector strip is mounted on said second target area.

4. The device of claim 3 wherein said simulated golfing green further includes a landing zone adjacent said target areas and disposed so as to lie between said target areas and the golfer.

5. The device of claim 4 wherein said simulated golfing green is inclined upwardly from the horizontal towards the golfer.

6. The device of claim 1 further comprising a second simulated golfing green substantially identical to said first simulated golfing green for positioning apart from said first simulated golfing green, a second surveillance means surveying above said second target area and cooperating with said second simulated golfing green, wherein said first surveillance means has a first field of view which includes said second simulated golfing green and wherein said second surveillance means has a second field of view which includes said first simulated golfing green.

7. The device of claim 1 wherein said surveillance means provides for verifying a claim by a player that the player's uniquely identified golf ball which entered said hole-in-one aperture or landed on said first target area was legitimately shot by the golfer.

8. The device of claim 1 wherein said ball identification means includes a unique color applied to the uniquely identified game balls and a color detecting sensor cooperating with said ball collector and a ball washing apparatus.

9. The device of claim 1 wherein said bail collector includes a conduit leading to a ball manifold, and wherein said first target area includes a separate ball collector cooperating with said ball manifold via additional conduits.

10. The device of claim 9 wherein said first target area ball collector is an elongate ball collecting trough mounted generally laterally across said first target area.

11. The device of claim 10 wherein a first ball collecting trough is mounted laterally across said first target area, and wherein at least a second ball collecting trough is mounted laterally across said second target area.

12. The device of claim 11 wherein said first and said at least a second ball collecting trough feed separate conduits which feed into a ball manifold, a ball identification sensor mounted in cooperation with said manifold so as to detect uniquely identified game balls.

13. The device of claim 1 wherein said conduit includes friction bumpers within said curved path to further rotationally bias the ball in its rotation as it passes through said curved path so as to cause the ball to perform a two-axis spin as it passes Through said receiver antenna coil.

14. The device of claim 1 wherein said ball identification means includes a unique color applied to the uniquely identified game balls and a color detecting sensor.

15. A method for uniquely identifying a golf ball at a target comprising the steps of:

(a) providing a simulated golfing green first target area having a hole-in-one aperture therein, (b) providing a ball collector mounted under said aperture and detecting golf balls entering the aperture, (c) providing a ball identification means cooperating with said ball collector and identifying uniquely identified game balls from non-uniquely identified golf balls and transmitting identity information corresponding to each game ball of said game balls to a remote processing station and correlating the identity of a golfer with said identity information, (d) providing a surveillance means surveying above said first target area and cooperating with said first target area for remotely monitoring said first target area, (e) providing a first signal means and signalling the golfer and a remote monitor when a uniquely identified game ball has entered said aperture, (f) providing a first sensor means and detecting by said first sensor means when a uniquely identified game ball lands in said first target area and signalling the golfer and a remote monitor upon said detection, (g) providing radio frequency identification transponders and mounting them into the uniquely identified game balls and providing corresponding radio frequency identification sensors mounted into cooperation with said ball collector and identifying the game balls by radio frequency identification, and wherein, said radio frequency identification sensors include a receiver antenna coil and wherein said radio frequency identification transponders are RFID tags having a sensitive axis whereby, when oriented perpendicular to a winding of said receiver antenna coil is readable by said receiver coil, and wherein said each tag has a non-sensitive axis of orientation where it is least sensitive corresponding to when a transmitting antenna coil of said each tag is in axial alignment with said receiver antenna coil, and wherein said ball identification means includes a curved conduit adapted so that a golf ball rolls through said receiver antenna coil along a curved path such that the ball changes its path direction by ninety degrees while rolling through said receiver antenna coil, said receiver antenna coil mounted adjacent said conduit corresponding to said curved path, and wherein said receiver antenna coil is formed into an ellipse and biased such that a coil-winding axis of said receiver antenna coil follows said curved path.

16. The method of claim 15 further comprising the step of providing at least a second target area which at least partially surrounds said first target area, and providing a second sensor means and detecting by said second sensor means when a uniquely identified game ball lands on said second target area and signalling the golfer and a remote monitor upon said detection, and correlating the identity of the game ball to a golfer.

17. The method of claim 16 further comprising providing a ball collector strip mounted on said second target area.

18. The method of claim 17 further comprising providing a landing zone adjacent said target areas and disposed so as to lie between said target areas and the golfer.

19. The method of claim 18 further comprising inclining said golfing green upwardly from the horizontal towards the golfer.

20. The method of claim 15 further comprising providing a second simulated golfing green substantially identical to said first simulated golfing green and positioning said second simulated golfing green apart from said first simulated golfing green, providing a second surveillance means surveying above said second target area and cooperating with said second simulated golfing green, wherein said first surveillance means has a first field of view which includes said second simulated golfing green and wherein said second surveillance means has a second field of view which includes said first simulated golfing green, and said second surveillance means monitoring said first simulated golfing green and said first surveillance means simultaneously monitoring said second simulated golfing green.

21. The method of claim 15 wherein said surveillance means provides for verifying a claim by a player that the player's uniquely identified golf ball which entered said hole-in-one aperture or landed on said first target area was legitimately shot by the golfer.

22. The method of claim 15 further comprising providing a unique color applied to the uniquely identified game balls and providing a color detecting sensor cooperating with said ball collector and sensing the game balls' colors so as to identify and sort game balls front other golf balls based on the color of the ball.

23. The method of claim 15 wherein said identifying step includes sensing the movement of the ball to be analyzed as it enters into an analysis area of said ball identification means, and providing therein multiple pairs of optical sensors, a first pair of optical sensors to determine that a ball is entering said area, a second pair of optical sensors, spaced downstream, for sensing that the ball has continued in its downstream motion.

24. The method of claim 15 includes providing color or contrast sensors and sensing the color or contrast of a golf ball to determine whether the golf ball is of a selected color or contrast, processing the sensor data to remove interference of extraneous markings, so as to provide differentiation data of the color or contrast of a range ball or a game ball, and retaining that information.

25. The method of claim 24 includes providing a third pair of optical sensors arranged to detect when a golf ball is in an eject location and, based on said differentiation data, ejecting game balls from a normal range ball flow path.

26. The method of claim 15 further comprising providing a unique color applied to the uniquely identified genie balls and providing a color detecting sensor.

* * * * *